United States Patent [19]

Mochizuki

[11] Patent Number: 4,525,940

[45] Date of Patent: Jul. 2, 1985

[54] BEACH SANDALS

[76] Inventor: Hideto Mochizuki, 4-61 Uwamachi, Yokusuka-shi, Kanagawa-ken, Japan

[21] Appl. No.: 482,140

[22] Filed: Apr. 5, 1983

[30] Foreign Application Priority Data

Sep. 19, 1982 [JP] Japan ..... 57-141533[U]
Sep. 19, 1982 [JP] Japan ..... 57-141534[U]

[51] Int. Cl.[3] ..... A43B 5/08

[52] U.S. Cl. ..... 36/8.1; 36/116; 36/3 B; 36/11.5

[58] Field of Search ..... 36/3 B, 8.1, 11.5, 103, 36/116, 29, 35 B

[56] References Cited

U.S. PATENT DOCUMENTS 1,373,287 3/1921 Ammann ..... 36/35 B
1,433,309 10/1922 Stimpson ..... 36/3 B
4,226,031 10/1982 Wong ..... 36/11.5

FOREIGN PATENT DOCUMENTS 2533622 7/1975 Fed. Rep. of Germany ..... 36/3 B
1461743 11/1966 France ..... 36/29
614170 12/1960 Italy ..... 36/101

*Primary Examiner*—Werner H. Schroeder
*Assistant Examiner*—Tracy Graveline
*Attorney, Agent, or Firm*—Kurt Kelman

[57] ABSTRACT

A beach sandal of improved comfort and enhanced safety comprises a sole provided with a plurality of perforations whose openings in the upper and lower surfaces of the sole are displaced or whose middle portions are displaced from their outer portions. The perforations provide an escape for the water drag on the wearer's foot and consequently make wading through water easier. Because the perforations are not formed perpendicularly, when the wearer happens to step on a sharp object such as a shell, the possibility of the object sliding through one of the perforations and reaching the foot is remote.

10 Claims, 21 Drawing Figures

BEACH SANDALS

BACKGROUND OF THE INVENTION

This invention relates to beach sandals, and more particularly to beach sandals which enable the wearer to wade through water easily and safely.

When a person wearing conventional beach sandals wades through water, he experiences difficulty in moving his feet forward because the sandals are subject to the drag of the water. There are even times when this drag pulls the sandals off his feet. To overcome this disadvantage, there have been proposed sandals which have perforations formed vertically through their soles. When the wearer of these sandals wades through water, the performations provide an outlet for part of the drag of the water and this partial escape of the water drag through the perforations reduces the sensation of drag on the wearer's feet by the water.

However, when the wearer of such sandals provided with vertical perforations happens to step on some extraneous object with sharp corners such as a shell, piece of wood or piece of metal while wading through water or walking on the beach, there is a possibility that the extraneous object will pass through one of these perforations and injure his foot.

SUMMARY OF THE INVENTION

An object of this invention is to provide highly safe beach sandals which reduce the sensation of drag on the wearer's feet when the wearer wades through water, enable the wearer to move his feet with ease in water, and protect the wearer's feet against injury when he happens to step on a sharp object.

To accomplish the object described above according to this invention, there is provided a beach sandal which comprises a sole provided with a plurality of slanted or curved perforations.

The perforations formed in the sole of the sandal are slanted or curved so that when the sandal is viewed straight on from the top it is not possible to see through them.

When the perforations are formed as straight slanted holes, the angle of the slanted holes should be such that the openings in the upper and lower surfaces of the sole do not overlap at all as seen from top. When the perforations are curved holes, at least the middle portions of the perforations should be displaced from their openings in the upper or lower surface of the sole by not less than the diameter of the perforations.

Since the soles of the sandals are provided with the plurality of such perforations, the water drag on the sandals when the wearer is wading through water is lessened and the wearer is enabled to move his feet easily in water. Since the perforations are slanted or curved as described above, any dangerous object which the wearer happens to step on is prevented from piercing through such perforations and reaching the wearer's foot. Thus, the sandals of this invention permit the wearer thereof to wade through water easily and safely.

The other objects and characteristic features of this invention will become apparent to those skilled in the art as the disclosure is made in the following description of preferred embodiments as illustrated in the accompanying drawings.

DESCRIPTION OF THE PREFERRED EMBODIMENTS

This invention relates to beach sandals which permit the wearer thereof to wade through water easily and safely.

Figure 1:
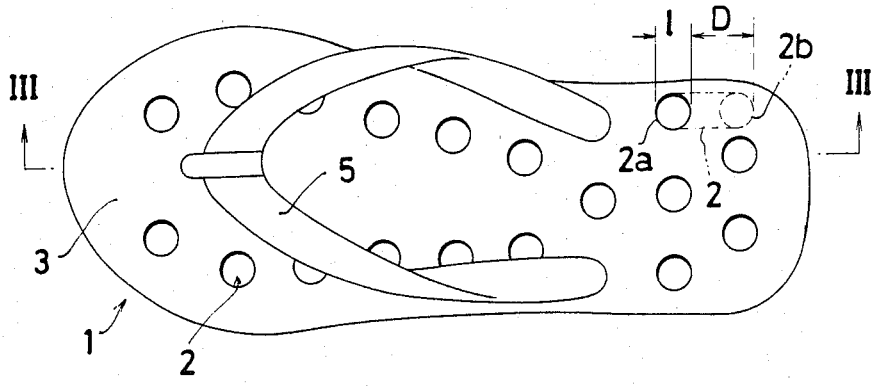
FIGS. 1 through 3 are a plan view, a bottom view, and a sectioned side view respectively of a typical beach sandal as one embodiment of the present invention.
Figure 2:
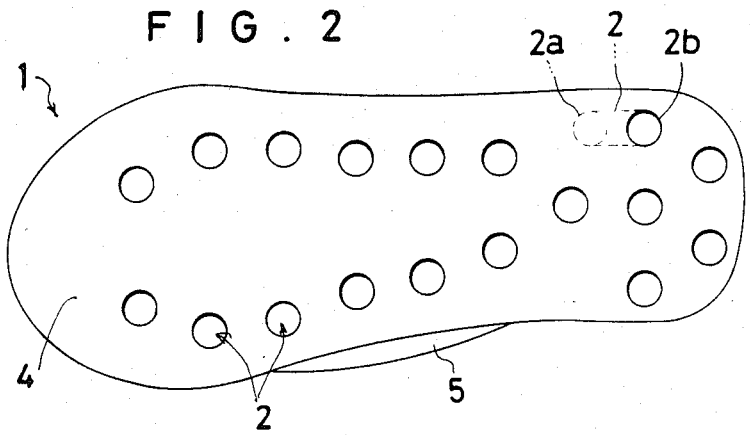
Figure 3:
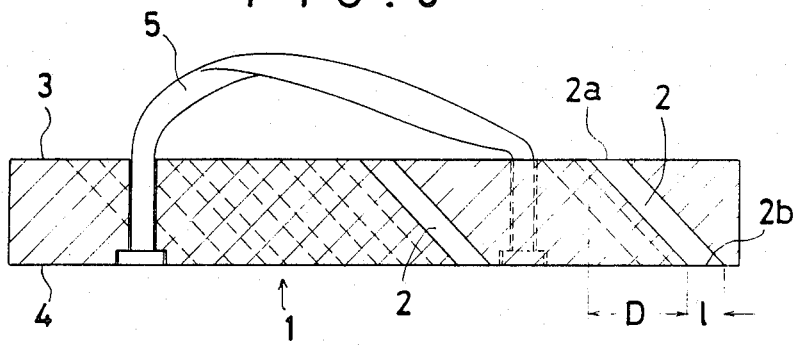

The beach sandal of the present invention, one embodiment of which is illustrated in FIGS. 1 through 3, comprises a sole 1 which is formed of a material possessed of flexibility and elasticity such as rubber or synthetic resin. The sole 1 is provided with a plurality of perforations 2 passing from the upper surface 3 through to the lower surface 4 thereof. The perforations 2 are formed not perpendicularly, but at an inclination, to the upper surface 3 and lower surface 4 of the sole 1. Although the angle of this inclination is not particularly limited, it is desired to be such that the displacement D between the openings *2a, 2b* of the perforations formed respectively in the upper surface 3 and the lower surface 4 of the sole 1 will be at least greater than the length l of the openings *2a, 2b* in the direction of the displacement thereof. When any of the perforations 2 is seen perpendicular to the sole 1, the opening of that perforation on the opposite surface is not visible. The perforations 2 need not necessarily be formed in a circular cross section as illustrated but may be formed in any desired cross section such as a rectangular or even a patterned section.

Denoted by 5 are thongs, which are not an element of the present invention.

When a person wears the beach sandals of the construction described above and wades through water, the drag of the water on the wearer's feet partially escapes through the perforations 2 formed in the sole 1. Even when the bottom surface of the sandal is set down on a flat underwater surface, it will not be sucked onto the flat surface as is experienced with the conventional sandal lacking a perforation. Thus, the wearer of the sandals of this invention can wade through water with ease. When the sandal is set down on an object with sharp corners such as a shell or piece of wood or metal, the object is prevented from passing through the perforations 2 and reaching the wearer's foot because the performations are slanted. Thus, the wearer's feet are protected from otherwise possible injury due to contact with such dangerous objects. These effects of the present invention can be enhanced by increasing the diameter of the individual perforations or by increasing the number of such perforations. If the diameter or number of the perforations is increased, however, the wearing comfort and the strength of the sandals are degraded. If the perforations are formed in a smaller diameter, the drag on the sandals when the wearer is wading through water is increased and there is a greater possibility of such perforations being clogged with coarse sand grains or gravel, for example.

As is evident from the effects aimed at by the present invention, the beach sandal of this invention is only required to have the perforations basically formed in a construction such that when the sandal is viewed straight on from the top, it is not possible to see through the perforations to the other side. Thus, the working examples and modifications thereto which will be cited hereinbelow are naturally embraced by the present invention as possessing the same effect.

Figure 4:
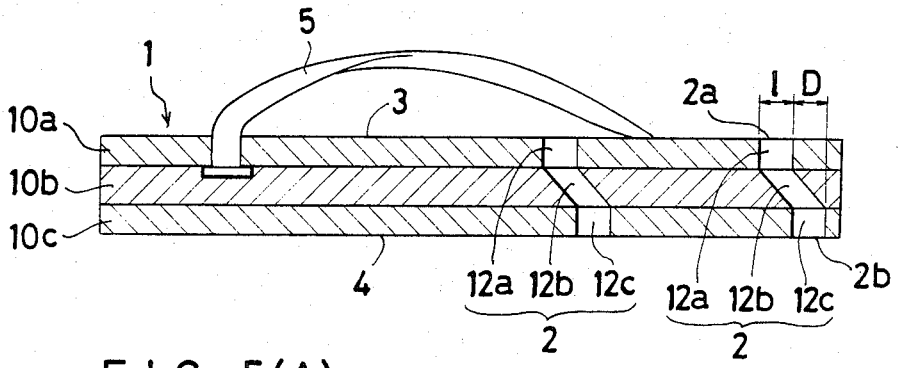
FIG. 4 is a sectioned side view of a beach sandal as another embodiment of the present invention.

The embodiment illustrated in FIG. 4 has the sole 1 of the sandal formed of three layers, i.e. an upper layer 10*a*, an intermediate layer 10*b*, and a lower layer 10*c*. Vertical holes 12*a*, 12*c* are formed in the upper layer 10*a* and the lower layer 10*c*, with the holes 12*a*, 12*c* displaced by a distance D which is greater than the diameter of the holes. Associated upper and lower holes 12*a*, 12*c* are joined to each other with slanted holes 12*b* which are formed in the intermediate layer 10*b*, to give rise to through holes 2.

In accordance with such a multi-layer construction of the sole of sandal as described above, perforations of complicated shapes as illustrated in FIG. 5 can be obtained with ease. By forming the upper layer 10*a* and the intermediate layer 10*b* of a highly flexible material and the lower layer 10*c* of a material of high antiabrasive property, there can be obtained a sandal which enjoys improved comfort of use and enhanced durability.

Figure 5A:
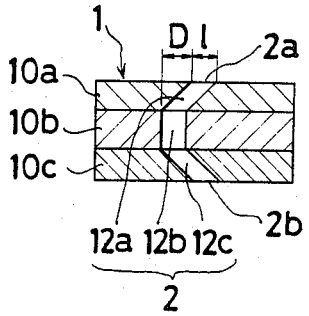
FIGS. 5(A) through 5(E) are partially sectioned views illustrating modifications to the beach sandal of FIG. 4.
Figure 5B:
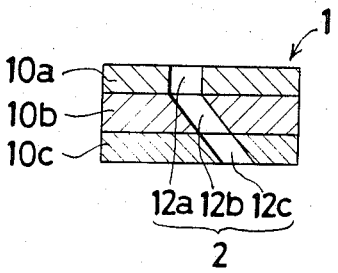
Figure 5C:
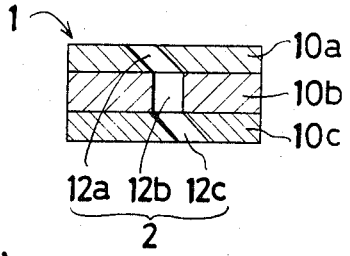
Figure 5D:
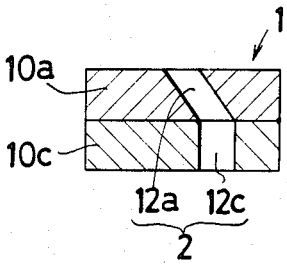
Figure 5E:
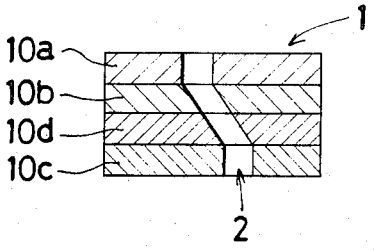

FIG. 5(A) depicts a modified sandal construction in which symmetrically slanted holes 12*a*, 12*c* are formed through the upper layer 10*a* and the lower layer 10*c* and these slanted holes joined to each other with vertical holes 12*b* formed in the intermediate layer 10*b*, to complete through holes 2. In this case, the openings 2*a*, 2*b* of the slanted holes in the upper and lower surfaces of the sole 1 vertically coincide with each other and they are displaced from the vertical holes 12*b* in the intermediate layer 10*b* by a distance D which is greater than the diameter l of the openings 2*a*, 2*b*. In the modified sandal construction of FIG. 5(B), vertical holes 12*a* are formed through the upper layer 10*a* and slanted holes 12*b*, 12*c* are formed through the intermediate layer 10*b* and the lower layer 10*c*. The vertical holes 12*a* and the slanted holes 12*b*, 12*c* are joined to one another under the same conditions as described above to give rise to curved through holes 2. In the modified sandal construction of FIG. 5(C), slanted holes 12*a*, 12*c* are formed through the upper and lower layers 10*a*, 10*c* and are joined to each other with vertical holes 12*b* formed through the intermediate layer 10*b*, to give rise to curved through holes 2. In the modified sandal construction of FIG. 5(D), a slanted hole 12*a* and a vertical hole 12*c* are formed respectively through the upper and lower layers 10*a*, 10*c*, to give rise to curved through holes 2. The modified sandal construction of FIG. 5(E) is equivalent to the sandal construction of FIG. 4, except that the intermediate layer is formed of two layers 10*b*, 10*d*. As described above, the perforations (through holes) 2 and the sole 1 may assume a wide variety of forms. From the embodiments and the modifications thereto so far described, it is evident that the sandal of this invention fulfills its function so far as the perforations 2 are not formed vertically through the sole 1.

Figure 6:
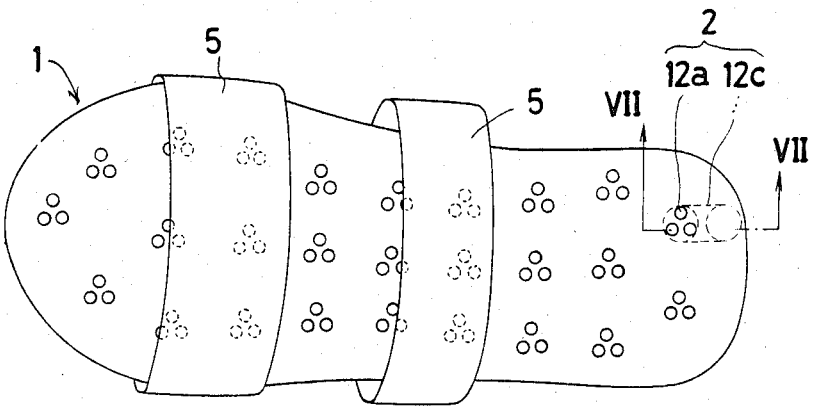
FIGS. 6 and 7 are a plan view and a partially sectioned view of a beach sandal as yet another embodiment of the present invention.
Figure 7:
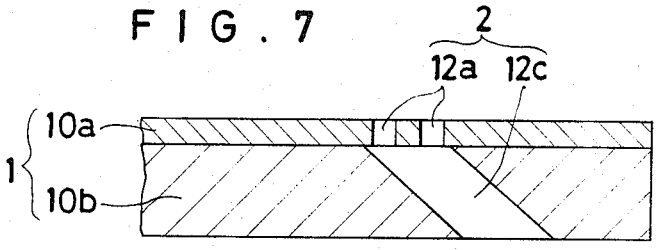

FIGS. 6 and 7 represent a further embodiment of this invention in which the sole 1 is formed of two layers, i.e. an upper layer 10*a* and a lower layer 10*b*. In this case, a plurality of holes 12*a* of a smaller diameter are formed through the upper layer 10*a* for each of the holes 12*c* of a larger diameter formed through the lower layer 10*b*. Moreover, the upper layer 10*a* which is required to be of a pleasing color from the standpoint of design and have high elasticity from the standpoint of comfort is comparatively expensive and, therefore, can be formed in a smaller thickness than the lower layer 10*b*, whereas the lower layer 10*b* which is required to possess relatively high rigidity can be formed of an inexpensive material. Thus, the beach sandal of this construction can be manufactured inexpensively.

In the sandal construction of this embodiment, the relatively small holes 12*a* formed through the upper layer 10*a* serve the purpose of impeding passage of extraneous objects through the sole 1. Any extraneous objects which may pass through the perforations 2 and find their way between the upper surface of the sole 1 and the foot are not so large as to cause an unpleasant sensation to the wearer of the sandal. Further since the holes 12*a* are small, the probability that an extraneous object having sharp corners such as a shell, if accidentally stepped on by the wearer, will slide along one of the perforations 2 and reach the foot is quite remote. Thus, this sandal is safe to use.

Figure 8A:
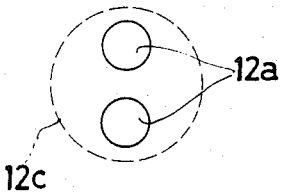
FIGS. 8(A) through 8(D) are partial views illustrating modifications to the beach sandal of FIG. 6.
Figure 8B:
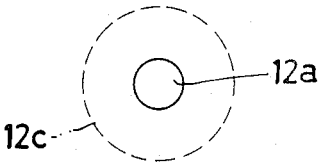
Figure 8C:
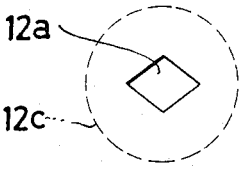
Figure 8D:
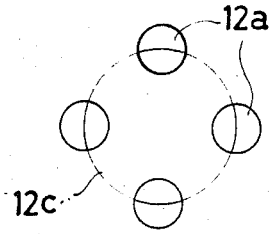

In this embodiment, the shape and number of the holes 12*a* formed through the upper layer 10*a* is not specifically limited. For example, two or more holes 12*a* may be parallelly disposed for each of the holes 12*c* as illustrated in FIG. 8(A). Otherwise, just one hole 12*a* of a smaller diameter may be disposed for each of the holes 12*c* as illustrated in FIG. 8(B). When desired, a hole 12*a* of a freely chosen design such as the shape of a rhomb may be disposed as illustrated in FIG. 8(C). Alternatively, a plurality of holes 12*a* may be symmetrically arranged as partly superposed on each of the holes 12*c* as illustrated in FIG. 8(D).

Figure 9:
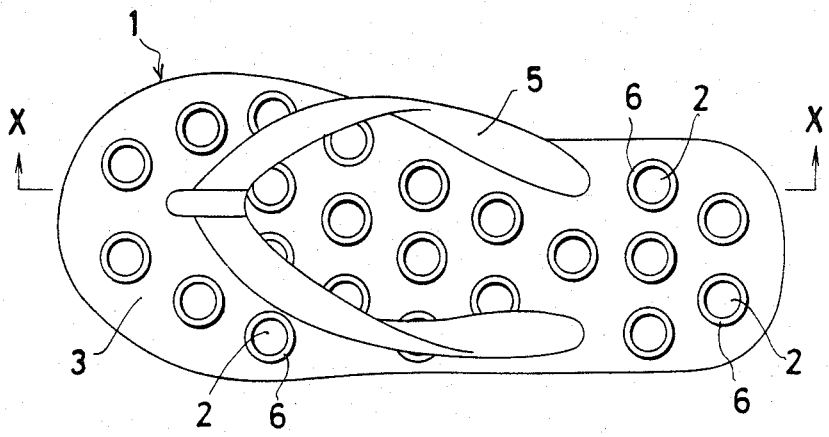
FIGS. 9 and 10 are a plan view and a sectioned side view illustrating a beach sandal as still another embodiment of the present invention.
Figure 10:
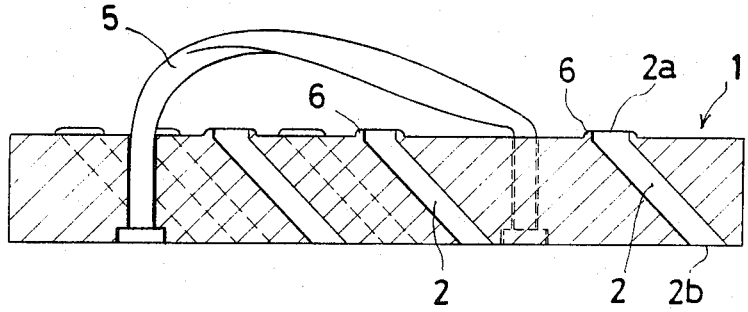

Yet another embodiment of this invention illustrated in FIGS. 9 and 10 has a protuberance 6 formed along the circumferential edge of the opening 2*a* of each of the perforations 2 on the upper surface of the sole 1. The protuberances 6 serve to increase the friction between the foot and the upper surface of the sole 1 and enable the wearer of the sandal to enjoy enhanced stability. Further, the protuberances 6 impart a pleasant stimulation like a massage to the foot.

Figure 11:
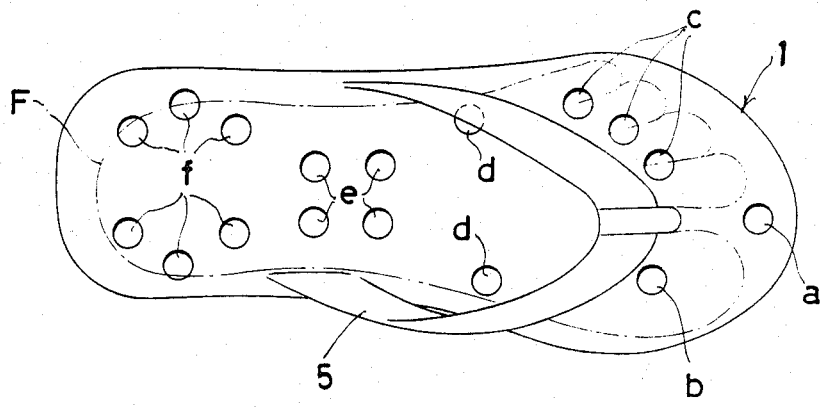
FIGS. 11 through 13 are a plan view and a sectioned side view illustrating a beach sandal as a further embodiment of the present invention.
Figure 12:
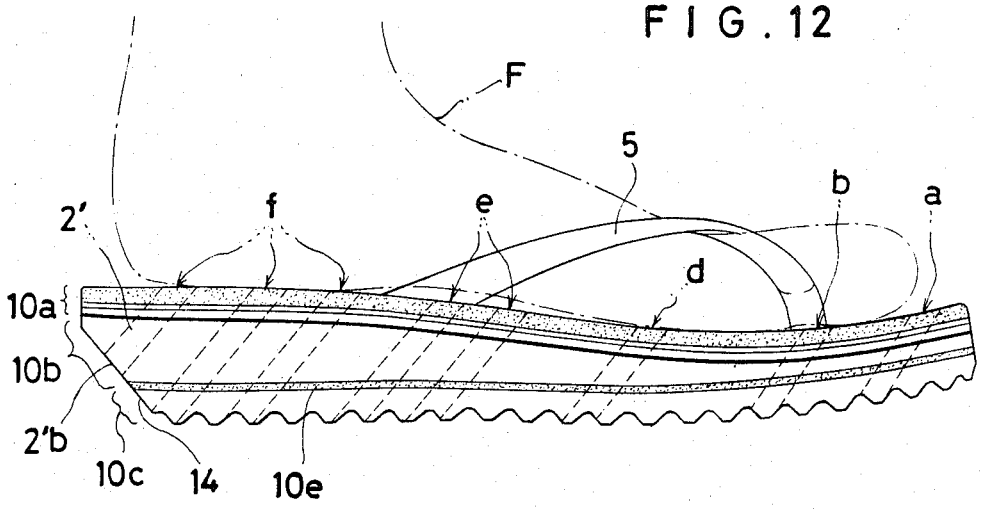
Figure 13:
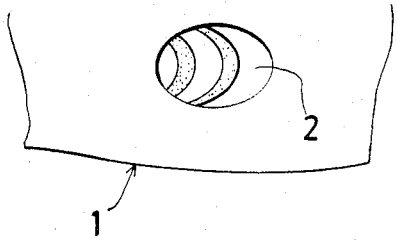

FIGS. 11 and 12 represent still another embodiment of this invention having a preferred arrangement of the perforations and a preferred construction of the sole 1. For the purpose of permitting the perforations to fulfill their function thoroughly, these perforations are desired to be disposed at positions so selected that the wearer's foot set in position on the upper surface of sandal will avoid closing the openings of the perforations in the upper surface of the sandal as much as possible. Specifically, the perforations should be formed in such positions that when the sandal is worn on the foot as illustrated, the openings of these perforations in the upper surface of the sandal occur outside the boundary of the foot (position a), below the root of the great toe (position b), below the positions between the toes (position c), below the opposite lateral sides of foot where the contact between the foot and the sandal is slight (positions d), below the arch of the foot (positions e), and around the heel of the foot (positions f). This particular arrangement of perforations is effective in allowing free passage of water through the perforations. Since the body weight is mainly borne on the great toe, the ball of the foot, and the heel, if the perforations are formed under such regions, the skin at these regions will sink into the perforations, causing an unpleasant sensation to the wearer. When the perforations are arranged as described above, however, these disadvantages can be precluded.

Figure 14:
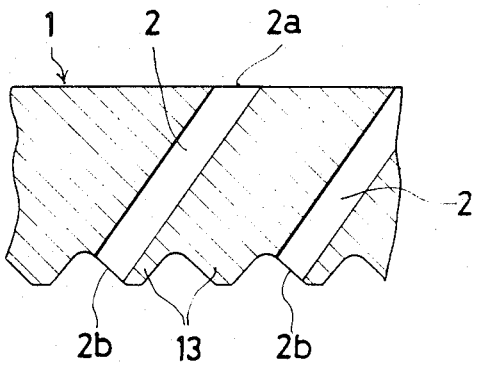
FIG. 14 is a partially sectioned side view illustrating the bottom of another typical beach sandal.

Further in the sole of the sandal of this embodiment, the upper layer 10*a* is formed of a plurality of layers of dissimilar colors, the intermediate layer 10*b* is formed in such a shape that the height decreases from the heel toward the tip, the lower layer 10*c* has the lower surface thereof formed in a corrugated shape, and a layer 10*e* of a different color is interposed between the intermediate layer 10*b* and the lower layer 10*c*. Since the upper layer 10*a* is formed of a plurality of dissimilar colors, the sandal as a whole enjoys improved appearance. As viewed from above, the perforations 2 assume an interesting color pattern. The interposition of the layer 10*e* of a different color between the intermediate layer 10*b* and the lower layer 10*c* also contributes to enhancing the appearance and design of the sandal. The increased height at the heel of the intermediate layer 10*b* mitigates the sensation of fatigue and adds to walking comfort. The corrugation of the lower surface of the lower layer 10*c* ensures prevention of slipping of the sandal on a smooth surface. Particularly when the wearer of the sandal is walking on a flat, wet, sandy beach, the corrugated lower surface of the sandal precludes the disadvantage that the interiors of the perforations will become airtight and cause the sandal to adhere fast to the sandy beach when the openings of the perforations in the upper surface of sandal are closed by the foot. This effect may be further enhanced by allowing the openings of the perforations 2 in the lower surface of the sandal to occur in the rearward slopes of the corrugation 13 as illustrated in FIG. 14. In consequence of this particular measure, the wearer of the sandal will no longer experience any difficulty in walking on a flat, wet, sandy beach even when the openings 2*a* of the perforations in the upper surface of sandal happen to be closed by the foot.

It is also permissible to cut aslant the lower part of the sole 1 of sandal and allow the opening 2*b*′ of the last perforation 2′ in the lower surface of sandal to be formed in the slanted surface 14 as illustrated in FIG. 12. This measure adds to the good appearance of the sandal and to the passage of water through the sole 1 of the sandal and prevents closure of the perforations.

In accordance with the present invention, since the plurality of perforations formed through the sole are slanted or curved so as not to pierce prependicularly through the sandal as observed straight on from the top, the water drag on the wearer's foot when walking in water can be effectively lessened so as to make movement of the feet easier. Besides, the sandal protects the wearer's foot against otherwise possible injuries that might occur when he happens to step on object with sharp corners such as a shell. Moreover, this invention can provide a beach sandal of good appearance from the standpoint of design.

What is claimed is:

1. A beach sandal which is comprised of a sole having a foot retaining means and further including a plurality of non-perpendicular through-holes arranged throughout the surface of the sole forming openings in the upper and lower surfaces thereof.

2. A beach sandal according to claim 1, wherein the amount of said displacement between the openings in the upper and lower surfaces is greater than the diameter of the openings in the direction of displacement.

3. A beach sandal according to claim 2, wherein protuberances are formed one each along the circumferential edges of the openings of said through holes in the upper surface of the sole.

4. A beach sandal according to claim 2, wherein the lower surface of the sole is corrugated.

5. A beach sandal according to claim 2, wherein the thickness of the sole is greater at the heel than at the toe.

6. A beach sandal according to claim 5, wherein the lower surface of the sole is corrugated.

7. A beach sandal according to claim 2, wherein said sole is formed of a plurality of layers.

8. A beach sandal according to claim 7, wherein at least one hole of a smaller diameter is formed through the upper layer of the sole for each hole formed through the lower layer.

9. A beach sandal according to claim 7, wherein the thickness of the sole is greater at the heel than at the toe.

10. A beach sandal according to claim 9, wherein the lower surface of the sole is corrugated.

* * * * *